US011128093B2

(12) United States Patent
Feng

(10) Patent No.: US 11,128,093 B2
(45) Date of Patent: Sep. 21, 2021

(54) ELECTRICAL CONNECTOR WITH A STABLE NON-SOLDERED GROUNDING STRUCTURE

(71) Applicant: Molex, LLC, Lisle, IL (US)

(72) Inventor: Ya Feng, ChengDu (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/827,710

(22) Filed: Mar. 24, 2020

(65) Prior Publication Data

US 2020/0313359 A1 Oct. 1, 2020

(30) Foreign Application Priority Data

Mar. 28, 2019 (CN) ..... 201910243625.3

(51) Int. Cl.

| | |
|---|---|
| ***H01R 13/6581*** | (2011.01) |
| ***H01R 25/00*** | (2006.01) |
| ***H01R 13/66*** | (2006.01) |
| ***H01R 13/631*** | (2006.01) |

(52) U.S. Cl.

CPC ..... *H01R 13/6581* (2013.01); *H01R 13/631* (2013.01); *H01R 13/665* (2013.01); *H01R 25/006* (2013.01)

(58) Field of Classification Search

CPC ..... H01R 13/6581; H01R 13/631; H01R 13/665; H01R 25/006; H01B 25/006

USPC ..... 439/374

See application file for complete search history.

(56) References Cited

U.S. PATENT DOCUMENTS 4,701,726 A * 10/1987 Holdsworth ..... H05K 9/0066 333/12
5,035,631 A * 7/1991 Piorunneck ..... H01R 13/6582 439/108
5,040,999 A * 8/1991 Collier ..... H01R 13/658 439/108
5,195,899 A * 3/1993 Yatsu ..... H01R 13/6471 439/101
5,288,247 A * 2/1994 Kaufman ..... G06K 7/0047 439/101

(Continued)

FOREIGN PATENT DOCUMENTS

CN 1182291 A 5/1998
CN 1349285 A 5/2002

(Continued)

*Primary Examiner* — Peter G Leigh

(57) ABSTRACT

An electrical connector includes an insulating housing, a plurality of terminals, an internal circuit board and a metal shield shell. The internal circuit board is provide to the insulating housing, and the internal circuit board is provided with a ground pad, an insertion gap is formed between the ground pad and the insulating housing. The metal shield shell is provided to the insulating housing, and the metal shield shell has a ground tongue, the ground tongue has a contact section, the contact section has a top surface and a bulge formed on an opposite side of the top surface, a distance between the top surface of the contact section of the ground tongue and a bottom surface of the bulge is larger than the insertion gap, the ground tongue inserts into the insertion gap and the contact section of the ground tongue is clamped between the insulating housing and the ground pad to make the bottom surface of the bulge contact the ground pad.

12 Claims, 11 Drawing Sheets

(56) References Cited

U.S. PATENT DOCUMENTS 5,419,708 A * 5/1995 Koss ..... H05K 1/117 439/59
5,470,259 A * 11/1995 Kaufman ..... H01R 13/6594 439/607.33
5,496,180 A * 3/1996 Fabian ..... H01R 4/028 439/60
5,537,294 A * 7/1996 Siwinski ..... H05K 5/0269 361/753
5,895,278 A * 4/1999 Humphrey ..... H01R 12/716 439/101
5,920,460 A * 7/1999 Oldendorf ..... H05K 5/0269 361/737
6,024,587 A * 2/2000 Garth ..... H05K 1/0218 439/101
6,068,500 A * 5/2000 Kantner ..... H01R 12/716 361/737
6,089,882 A * 7/2000 Costello ..... H01R 13/6583 439/95
6,322,392 B1 * 11/2001 Wang ..... H01R 13/6595 439/607.14
6,394,846 B1 5/2002 Belopolsky et al.
6,468,094 B2 * 10/2002 Kuo ..... H01R 12/707 439/108
6,692,271 B2 * 2/2004 Watanabe ..... H01R 12/716 439/108
7,241,181 B2 * 7/2007 Machado ..... H01R 13/514 439/541.5
7,332,984 B2 * 2/2008 Panetta ..... H01R 24/48 333/175
7,959,473 B2 * 6/2011 Machado ..... H01R 13/514 439/676
8,337,246 B2 * 12/2012 Zhang ..... H01R 13/6658 439/607.01
8,403,701 B2 * 3/2013 Han ..... H01R 13/6596 439/541.5
8,535,100 B2 * 9/2013 Ge ..... H01R 13/6658 439/620.17
8,579,660 B2 * 11/2013 Chow ..... H01R 13/514 439/607.01
8,579,661 B2 * 11/2013 Zhang ..... H01R 13/6658 439/607.01
8,636,545 B2 * 1/2014 Chow ..... H01R 13/514 439/607.27
8,678,857 B2 * 3/2014 Zhang ..... H01R 13/60 439/541.5
9,136,650 B2 * 9/2015 Xuan ..... H01R 13/6586
9,219,326 B2 * 12/2015 Zhang ..... H01R 13/6658
9,431,769 B2 * 8/2016 Gao ..... H01R 13/648
9,455,530 B2 * 9/2016 Patel ..... H01R 13/6597
9,520,687 B2 * 12/2016 Gao ..... H01R 24/64
9,640,885 B2 * 5/2017 Amini ..... H01R 13/6583
9,722,374 B2 * 8/2017 Hsu ..... H01R 27/02
2007/0270042 A1 11/2007 Belopolsky et al.
2008/0166918 A1 7/2008 Yang et al.
2008/0248695 A1 * 10/2008 Hu ..... H01R 24/64 439/620.22
2011/0151717 A1 * 6/2011 Ge ..... H01R 13/6658 439/620.07
2012/0115364 A1 * 5/2012 Han ..... H01R 13/6594 439/607.55
2012/0196478 A1 * 8/2012 Zhang ..... H01R 13/6587 439/607.01
2014/0045374 A1 * 2/2014 Tang ..... H01R 13/6581 439/569
2014/0308849 A1 * 10/2014 Hsu ..... H01R 13/6581 439/607.55
2014/0342608 A1 * 11/2014 Wu ..... H01R 13/6658 439/607.35
2015/0171577 A1 * 6/2015 Han ..... H01R 13/6675 439/620.23
2018/0233853 A1 * 8/2018 Janowiak ..... H01R 13/504
2018/0241148 A1 * 8/2018 Tang ..... H01R 12/7011

FOREIGN PATENT DOCUMENTS

CN 1252878 C 4/2006
CN 201717402 U 1/2011
CN 102237586 A 11/2011
CN 202076608 U 12/2011
CN 102623849 A 8/2012
CN 202712614 U 1/2013
CN 202856089 U 4/2013
CN 203377446 U 1/2014
CN 203747160 U 7/2014
CN 105703158 A 6/2016
TW 201032405 A 9/2010
TW M409619 U 8/2011
TW I415333 B 11/2013
TW M481523 U 7/2014
TW M503679 U 6/2015

* cited by examiner

ELECTRICAL CONNECTOR WITH A STABLE NON-SOLDERED GROUNDING STRUCTURE

RELATED APPLICATION

This application claims priority to Chinese Application No. 201910243625.3, filed on Mar. 28, 2019, which is incorporated by reference in its entirety.

TECHNICAL FIELD

The present disclosure relates to an electrical connector, particularly relates to an electrical connector with an internal circuit board.

BACKGROUND

Chinese utility model patent application issuance publication NO. CN203747160U (corresponding to Taiwanese utility model patent application issuance publication No. TWM481523) discloses an electrical connector which includes a shield shell, an insulating body receiving in the shield shell, and a magnetic module, the shield shell includes a ground leg extending horizontally into a notch, the ground leg is connected with an internal circuit board in the notch opened forwardly on a rear edge of an insulating housing. The ground leg of the electrical connector needs to be connected with the internal circuit board by soldering, so that the manufacturing cost is higher and the manufacturing efficiency is lower.

A grounding configuration disclosed in U.S. patent No. 6,394,846 is that a spring plate of the shield shell elastically contacts a circuit board. Since the spring plate is only a cantilevered elastic contact, the spring plate is easy to bend due to an external force to cause poor contact. And the contact of the spring plate is usually point-to-point contact, so the contact has higher contact impedance.

SUMMARY

Therefore, an object of the present disclosure is to provide an electrical connector having a stable ground structure.

Accordingly, in some embodiments, an electrical connector of the present disclosure comprises an insulating housing, a plurality of terminals, an internal circuit board and a metal shield shell. The internal circuit board is provide to the insulating housing, and the internal circuit board is provided with a ground pad, an insertion gap is formed between the ground pad and the insulating housing. The metal shield shell is provided to the insulating housing, and the metal shield shell has a ground tongue, the ground tongue has a contact section, the contact section has a top surface and a bulge formed on an opposite side of the top surface, a distance between the top surface of the contact section of the ground tongue and a bottom surface of the bulge is larger than the insertion gap, the ground tongue inserts into the insertion gap and the contact section of the ground tongue is clamped between the insulating housing and the ground pad to make the bottom surface of the bulge contact the ground pad.

In some embodiments, the bottom surface of the bulge of the ground tongue forms a contact plane portion which contacts the ground pad face-to-face.

In some embodiments, the insulating housing has a pressing surface corresponding to the insertion gap and protruding toward the ground pad, the contact section of the ground tongue is clamped between the pressing surface and the ground pad.

In some embodiments, the insulating housing has a guiding oblique surface corresponding to an entrance of the insertion gap.

In some embodiments, the contact section of the ground tongue further has a guiding edge portion which is positioned at a distal end and obliquely extends cooperatively corresponding to the guiding oblique surface.

Accordingly, in some embodiments, the electrical connector of the present disclosure comprises a first insulating housing. at least a terminal module, an internal circuit board and a metal shield shell. The terminal module is provided to the first insulating housing, the terminal module comprises a second insulating housing and a plurality of terminals. The internal circuit board is provided to the second insulating housing of the terminal module, the internal circuit board is provided with a ground pad, an insertion gap is formed between the ground pad and the second insulating housing. The metal shield shell covers the insulating housing, the metal shield shell has a ground tongue, the ground tongue has a contact section, the contact section has a top surface and a bulge formed on an opposite side of the top surface, a distance between the top surface of the contact section of the ground tongue and a bottom surface of the bulge is larger than the insertion gap, the ground tongue inserts into the insertion gap and the contact section of the ground tongue is clamped between the insulating housing and the ground pad to make the bottom surface of the bulge contact the ground pad.

In some embodiments, the bottom surface of the bulge of the ground tongue forms a contact plane portion which contacts the ground pad face-to-face.

In some embodiments, the second insulating housing has a pressing surface corresponding to the insertion gap and protruding toward the ground pad, the contact section of the ground tongue is clamped between the pressing surface and the ground pad.

In some embodiments, the second insulating housing has a guiding oblique surface corresponding to an entrance of the insertion gap.

In some embodiments, the contact section of the ground tongue further has a guiding edge portion which is positioned at a distal end and obliquely extends cooperatively corresponding to the guiding oblique surface.

In some embodiments, the first insulating housing has an avoiding opening through which the ground tongue passes to insert into the insertion gap.

In some embodiments, the ground tongue further has a bending section extending into the avoiding opening of the first insulating housing to make the contact section insert into the insertion gap.

The present disclosure at least has the following technical effects: the insulating housing and the ground pad of the internal circuit board clamp the ground tongue, so that the ground tongue and the ground pad of the internal circuit board are kept in stable and reliable contact. In addition, the contact plane portion of the bottom surface of the bulge of the ground tongue and the ground pad form face-to-face contact, which can reduce contact impedance between the ground tongue and the ground pad. In addition, furthermore, since the ground tongue and the internal circuit board have elasticity, when the electrical connector is subjected to mechanical impact and vibration, the ground tongue and the ground pad of the internal circuit board can still stably contact each other.

BRIEF DESCRIPTION OF THE DRAWINGS

Other features and technical effects of the present disclosure will be apparent in embodiments referring to the accompanying figures, in which.

DETAILED DESCRIPTION OF THE PREFERRED EMBODIMENTS

Figure 1:
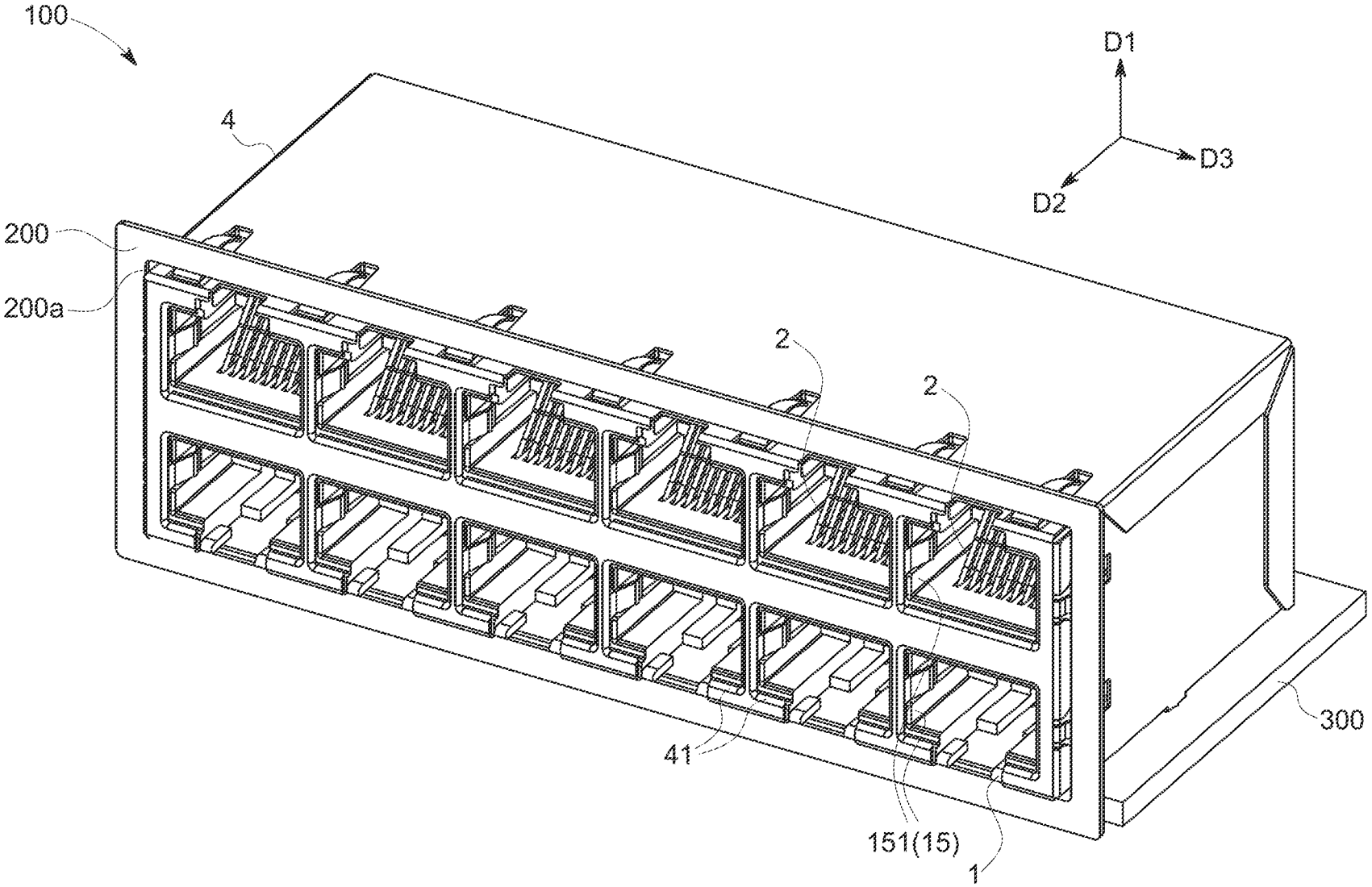
FIG. 1 is a perspective view of an embodiment of an electrical connector of the present disclosure.

Before the present disclosure is described in detail, it should be noted that like elements are denoted by the same reference numerals in the following description.

Referring to FIG. 1 to FIG. 4, an embodiment of an electrical connector 100 of the present disclosure is adapted to be provided in a casing 200 of a device and is electrically connected with a main circuit board 300 in the casing 200 of the device, the casing 200 has an hole 200*a* through which the electrical connector 100 is exposed. The electrical connector 100 includes a first insulating housing 1, a plurality of terminal modules 2, an internal circuit board 3 and a metal shield shell 4. It should be noted that, in other varied embodiments, the electrical connector 100 may only include one terminal module 2, which is not limited by the embodiment.

Referring to FIG. 3 to FIG. 7, the first insulating housing 1 has a front end face 11 and a rear end face 12 which are opposite to each other in a mating direction D1, a top face 13 and a bottom face 14 which are opposite to each other in an up-down direction D2 perpendicular to the mating direction D1, a plurality of accommodating grooves 15 extending forwardly from the rear end face 12 and arranged side by side in a width direction D3 perpendicular to the mating direction D1, and a plurality of first positioning posts 16 extending downwardly from the bottom face 14. When the electrical connector 100 is provided in the casing 200 of the device, the front end face 11 of the first insulating housing 1 is substantially aligned with the hole 200*a* and faces an outside of the casing 200. Each accommodating groove 15 has two mating insertion grooves 151 positioned on the front end face 11 and arranged and spaced apart from each other in the up-down direction D2, a rear end opening 152 positioned on the rear end face 12, and a bottom opening 153 positioned on the bottom face 14 and communicated with the rear end opening 152.

Each terminal module 2 includes a second insulating housing 21, an interface circuit board 22 and two terminal assemblies 23. The second insulating housing 21 has a front end face 211 facing the mating direction D1, a top face 212 and a bottom face 213 opposite to each other in the up-down direction D2, and a plurality of second positioning posts 214 extending downwardly from the bottom face 213. The interface circuit board 22 is provided to the top face 212 of the second insulating housing 21, and the interface circuit board 22 extends forwardly beyond the front end face 211 of the second insulating housing 21 in the mating direction D1. The two terminal assemblies 23 are positioned in front of the second insulating housing 21 and respectively provided to the top face 221 and the bottom face 222 of the interface circuit board 22, each terminal assembly 23 includes an insulating block 231 and a plurality of terminals 232 which are partially embedded in the insulating block 231 and arranged side by side along the width direction D3 and are bent and have elasticity, the plurality of terminals 232 are respectively electrically connected to circuit traces on the interface circuit board 22 by soldering. The plurality of terminal modules 2 are respectively provided in the plurality of accommodating grooves 15 of the first insulating housing 1 via the plurality of rear end openings 152, the terminals 232 of the two terminal assemblies 23 of each terminal module 2 are respectively assembled in the two mating insertion grooves 151 of the corresponding accommodating groove 15, and the bottom face 213 of the second insulating housing 21 of each terminal module 2 is exposed through the bottom opening 153 of the corresponding accommodating groove 15.

Figure 2:
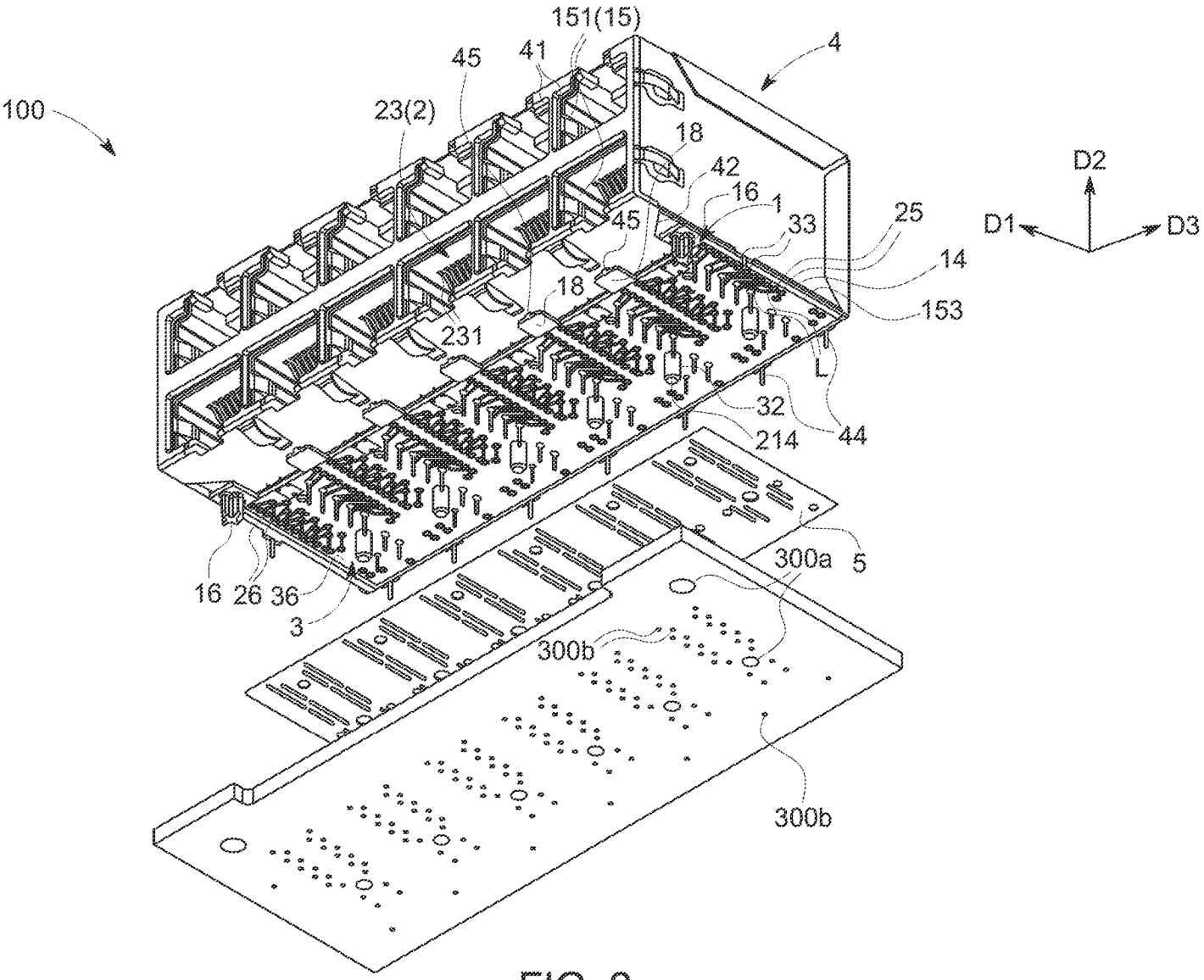
FIG. 2 is an exploded perspective view of the embodiment, in which a casing is not shown, and a main circuit board and an insulating layer are exploded in the electrical connector.
Figure 3:
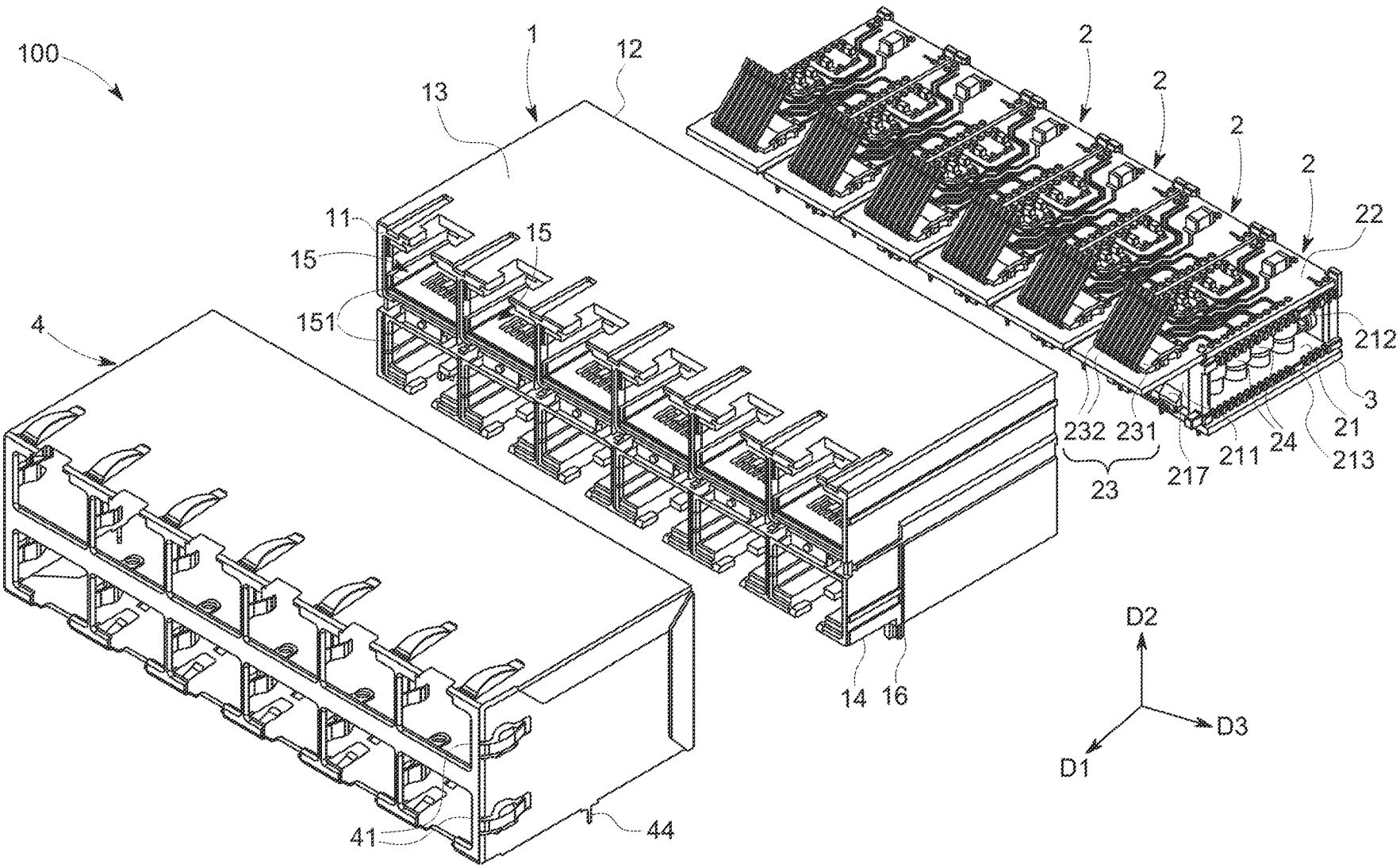
FIG. 3 is a further exploded perspective view based on FIG. 2.
Figure 4:
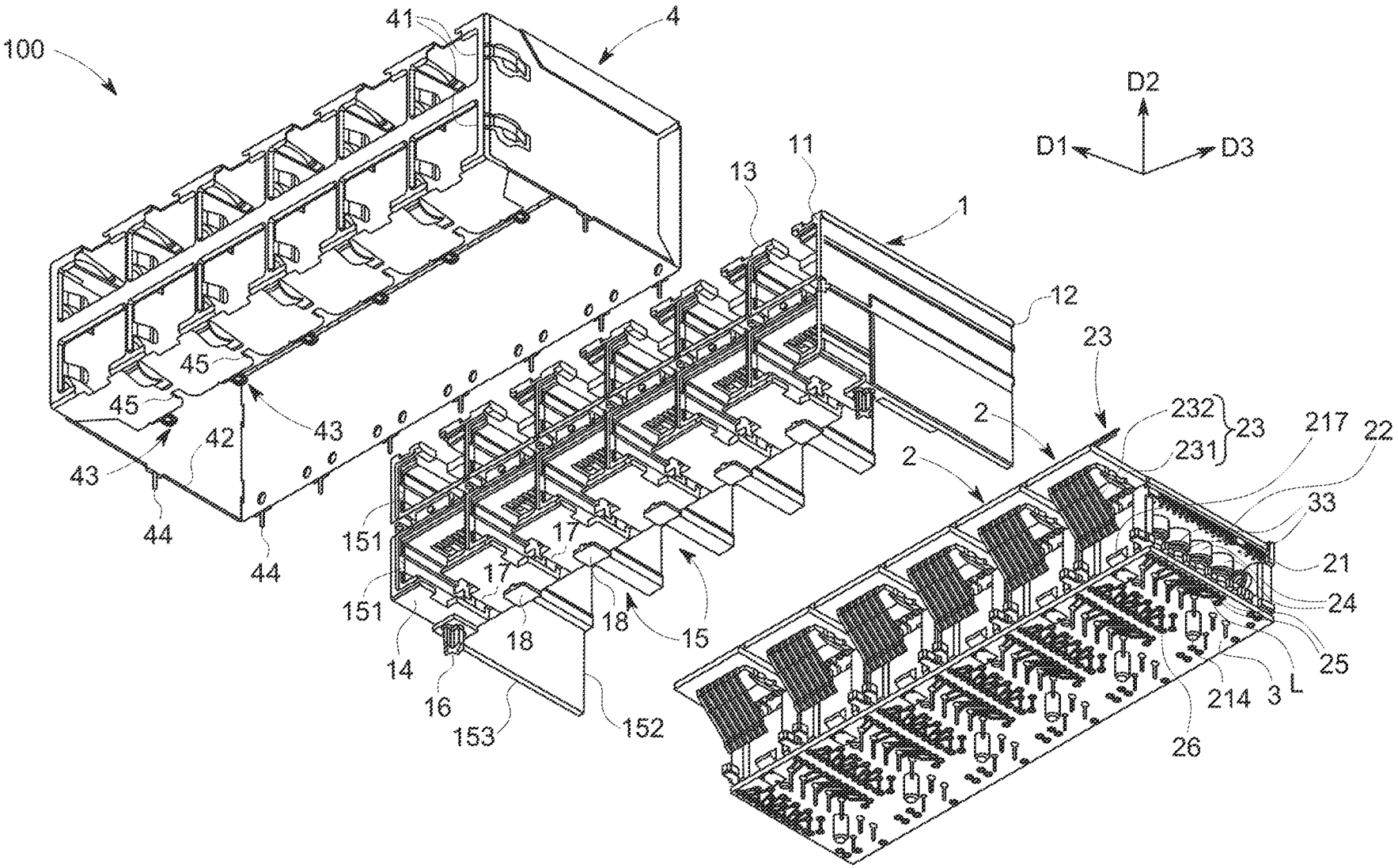
FIG. 4 is an exploded perspective view of FIG. 3 viewed from another angle.
Figure 5:
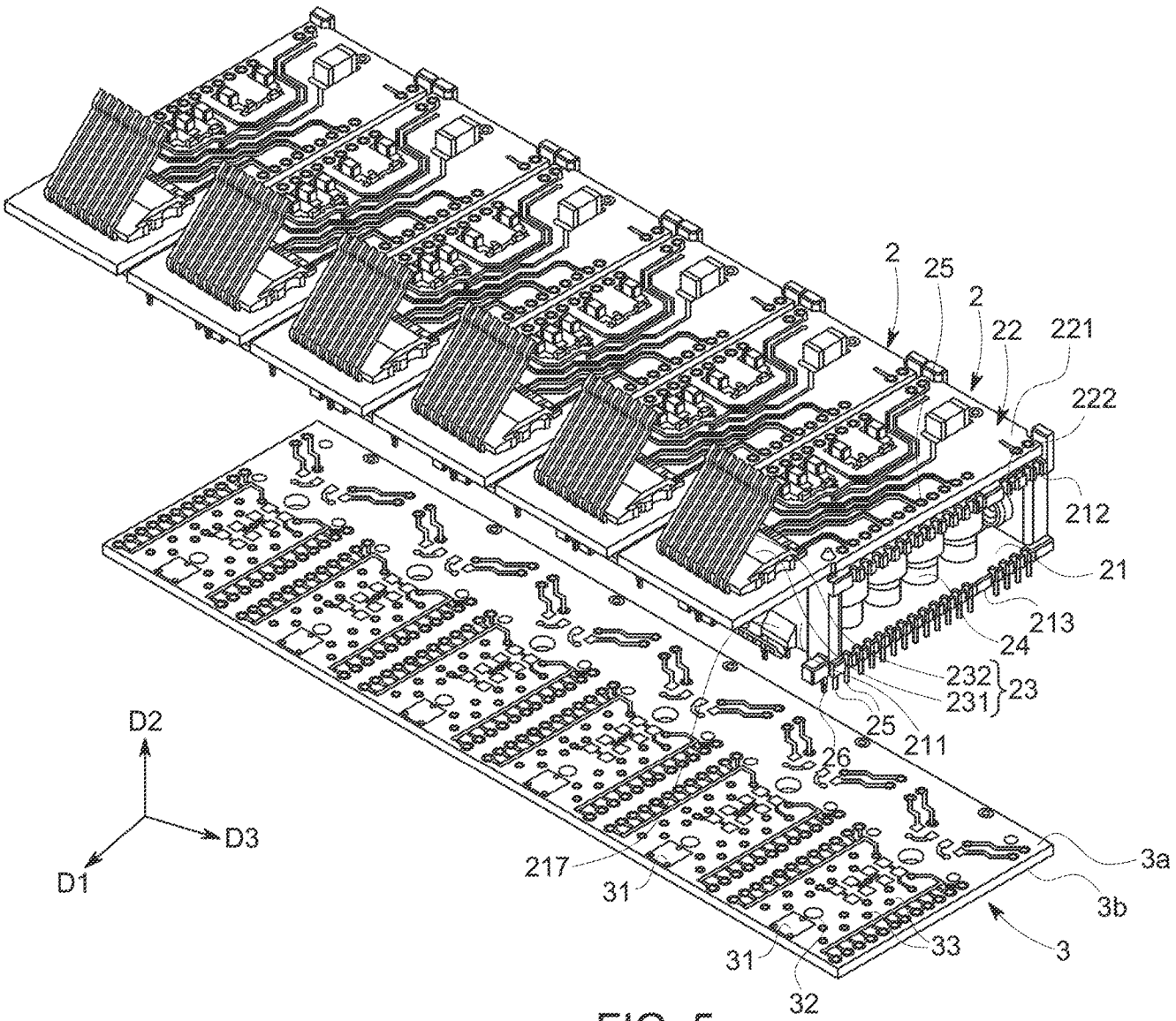
FIG. 5 is a further exploded perspective view based on FIG. 3.
Figure 6:
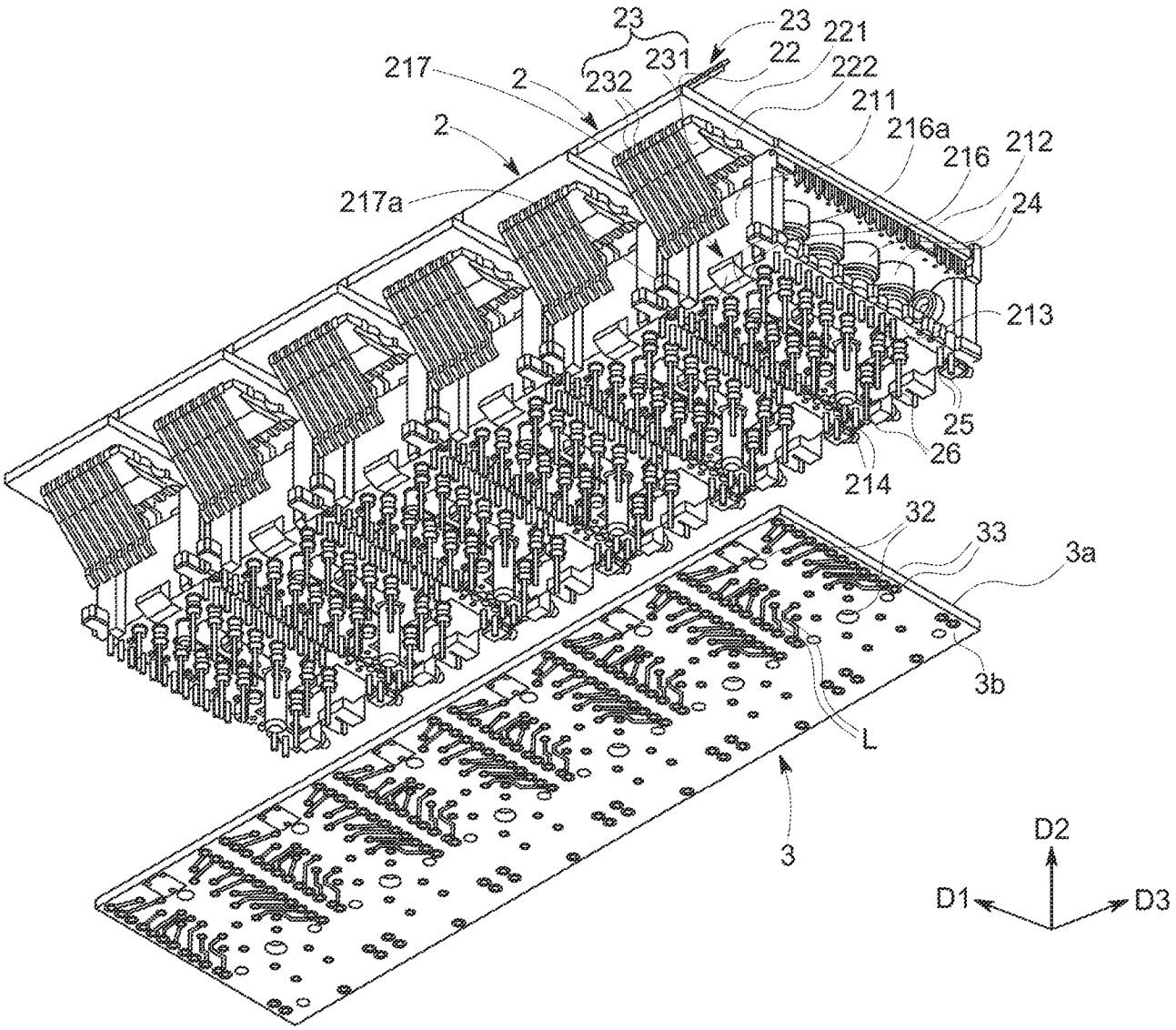
FIG. 6 is an exploded perspective view of FIG. 5 viewed from another angle.

The internal circuit board 3 extends in the width direction D3 and is provided to the bottom faces 213 of the second insulating housings 21 of the plurality of terminal modules 2 via the bottom openings 153 of the plurality of accommodating grooves 15, and the internal circuit board 3 is electrically connected with the plurality of interface circuit boards 22. Specifically, each terminal module 2 further has a plurality of electronic elements 24 which are provided to the second insulating housing 21 and electrically connected between the interface circuit board 22 and the internal circuit board 3, the electronic elements 24 are provided between the top face 212 and the bottom face 213 of the second insulating housing 21, the interface circuit board 22 is electrically connected with the electronic elements 24 via a plurality of pins 25, the electronic elements 24 is electrically connected with the internal circuit board 3 via a plurality of pins 25. The electronic elements 24 may be, for example, components such as filters or rectifiers and the like which can optimize signals. The internal circuit board 3 and the main circuit board 300 (see FIG. 2) are respectively provided with conductive traces L, conductive insertion holes 33, 300*b* connected to the conductive traces L, and conductive connecting members connected to the conductive insertion holes 33, 300*b*, a plurality of conductive legs 26 respectively insert into the conductive insertion holes 33 of the internal circuit board 3 and the conductive insertion holes 300*b* of the main circuit board 300, so as to electrically connect the conductive traces L of the internal circuit board 3 and the conductive traces L of the main circuit board 300 via the legs 26. The leg 26 may be, for example, a press-fit leg with a double needle eye construction. Signals of the plurality of terminal modules 2 are transmitted to the main circuit board 300 after being processed via the above configuration. The internal circuit board 3 has a plurality of ground pads 31 provided on a top face 3*a* adjacent to a front side edge thereof and respectively corresponding to the plurality of second insulating housings 21, and a plurality of positioning holes 32 through which the second positioning posts 214 of the plurality of second insulating housings 21 pass. An insertion gap G is formed between each ground pad 31 and the corresponding second insulating housing 21. In the embodiment, the main circuit board 300 is stacked under the internal circuit board 3, and the main circuit board 300 is formed with a plurality of positioning holes 300*a* through which the plurality of first positioning posts 16 and the plurality of second positioning posts 214 pass. In addition, as shown in FIG. 2, an insulating layer 5 is provided between the internal circuit board 3 and the main circuit board 300 to avoid a short circuit between the internal circuit board 3 and the main circuit board 300.

Referring to FIG. 4 and FIG. 7 to FIG. 11, the metal shield shell 4 covers the first insulating housing 1, the metal shield shell 4 has a rear cover which can close the rear end opening 152 of the first insulating housing 1, and a plurality of elastic pieces are provided along a peripheral edge of the metal shield shell 4 to contact a peripheral edge of the hole 200*a* of the casing 200 to achieve a grounding effect. A front end face of the metal shield shell 4 has a plurality of windows 41 corresponding to the plurality of mating insertion grooves 151 of the first insulating housing 1, a bottom of the metal shield shell 4 integrally has a bottom plate, an opening 42 behind the bottom plate, and a plurality of ground tongues 43 respectively extending rearwardly from the bottom plate toward the corresponding insertion gaps G, lower edges of a rear plate and a side plate of the metal shield shell 4 have a plurality of ground legs 44 extending downwardly and passing through positioning holes of the main circuit board 300. Each ground tongue 43 has a contact section 431, the contact section 431 has a top surface 431*a* and a bulge 431*b* punched from up to down to form on an opposite side of the top surface 431*a*, a distance between the top surface 431*a* of the contact section 431 of each ground tongue 43 and the bottom surface 431*c* of the bulge 431*b* is greater than the corresponding insertion gap G, after each ground tongue 43 inserts into the corresponding insertion gap G, the internal circuit board 3 is elastically deformed by the ground tongue 43 for generating a clamping force to the ground tongue 43, so that the contact section 431 of the ground tongue 43 is clamped between the corresponding second insulating housing 21 and the ground pad 31 to make the bottom face 431 of the bulge 431*b* contact the corresponding ground pad 31 with a contact force, and therefore, when the electrical connector 100 is subjected to mechanical impact and vibration, the ground tongue 43 and the ground pad 31 can still stably contact each other. The second insulating housing 21 and the ground pad 31 of the internal circuit board 3 clamp the ground tongue 43 to make the ground tongue 43 and the ground pad 31 of the internal circuit board 3 keep in stable and reliable contact. Furthermore, since the ground tongue 43 also has elasticity, the ground tongue 43 can further increase the contact force pressing on the ground pad 31, so that the contact force between the bottom surface 431*c* of the bulge 431*b* and the ground pad 31 is larger, therefore the contact between the ground tongue 43 and the ground pad 31 is more stably kept when the electrical connector 100 is subjected to mechanical impact and vibration.

Referring to FIG. 7 to FIG. 12, furthermore, in the embodiment, the bottom surface 431*c* of the bulge 431*b* of the ground tongue 43 forms a contact plane portion 431*d* which contacts the ground pad 31 face-to-face, thereby increasing a contact area between the ground tongue 43 and the ground pad 31 to reduce the contact impedance between the ground tongue 43 and the ground pad 31. Each second insulating housing 21 has a pressing protrusion 216 corresponding to the insertion gap G and protruding from the bottom face 213 toward the corresponding ground pad 31, and a guiding protrusion 217 corresponding to an entrance of the insertion gap G and extending forwardly from the front end face 211 and connected with the pressing protrusion 216, the pressing protrusion 216 has a pressing face 216*a* facing the corresponding ground pad 31, the contact section 431 of the ground tongue 43 is clamped between the pressing face 216*a* and the ground pad 31. The guiding protrusion 217 has a guiding oblique surface 217*a* connected to the pressing face 216*a*, the guiding oblique surface 217*a* obliquely extends forwardly and upwardly from an end which is connected to the pressing face 216*a* toward a direction away from the ground pad 31. And, the contact section 431 of the ground tongue 43 further has a guiding edge portion 431*e* which is positioned at a distal end and obliquely extends rearwardly and downwardly toward a direction close to the ground pad 31. With the cooperation of the guiding oblique surface 217*a* and guiding edge portion 431*e*, the contact section 431 of the ground tongue 43 can more smoothly insert into the insertion gap G, thereby facilitating assembling.

Figure 7:
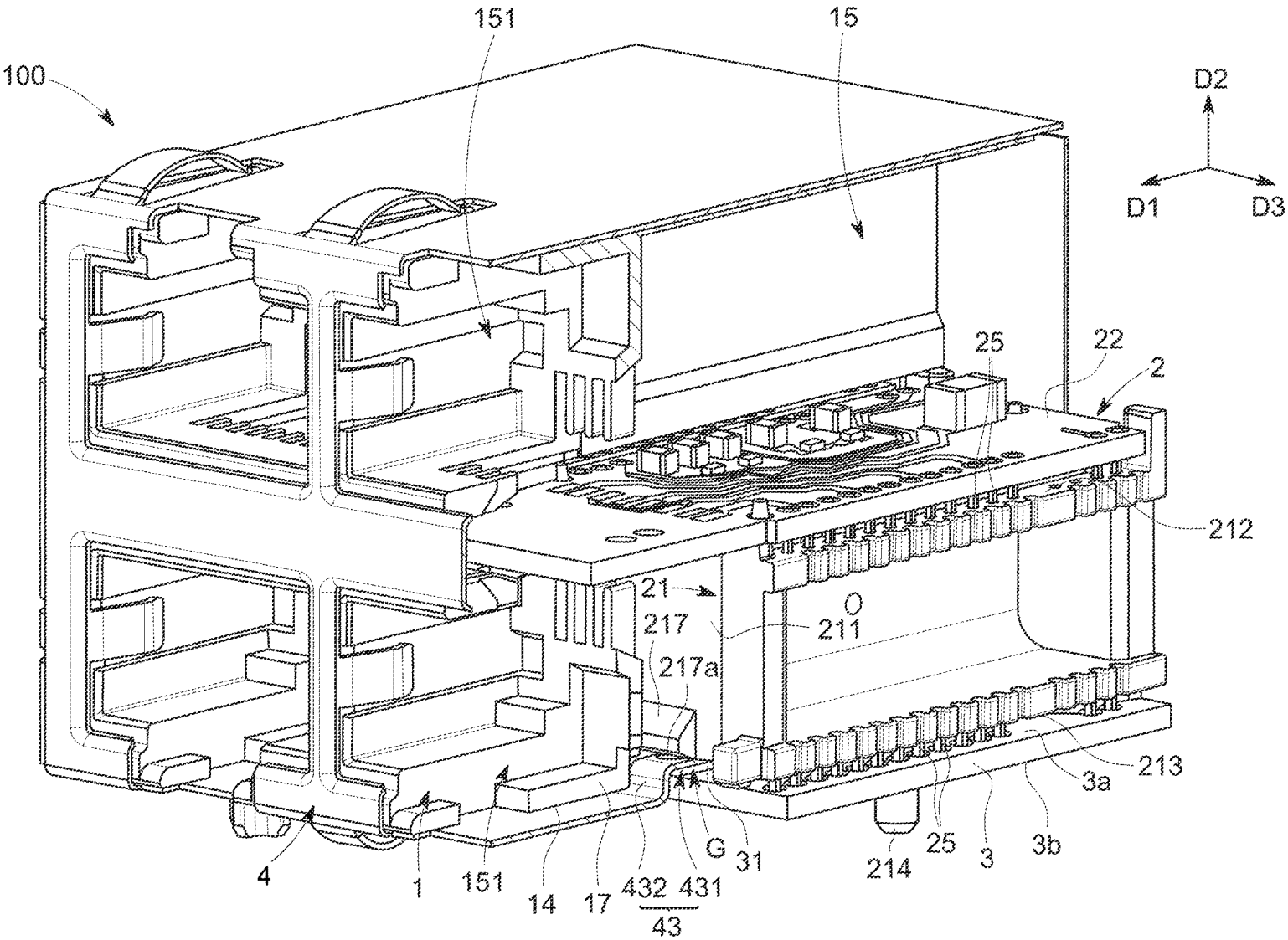
FIG. 7 is a cross sectional perspective view of the embodiment.
Figure 8:
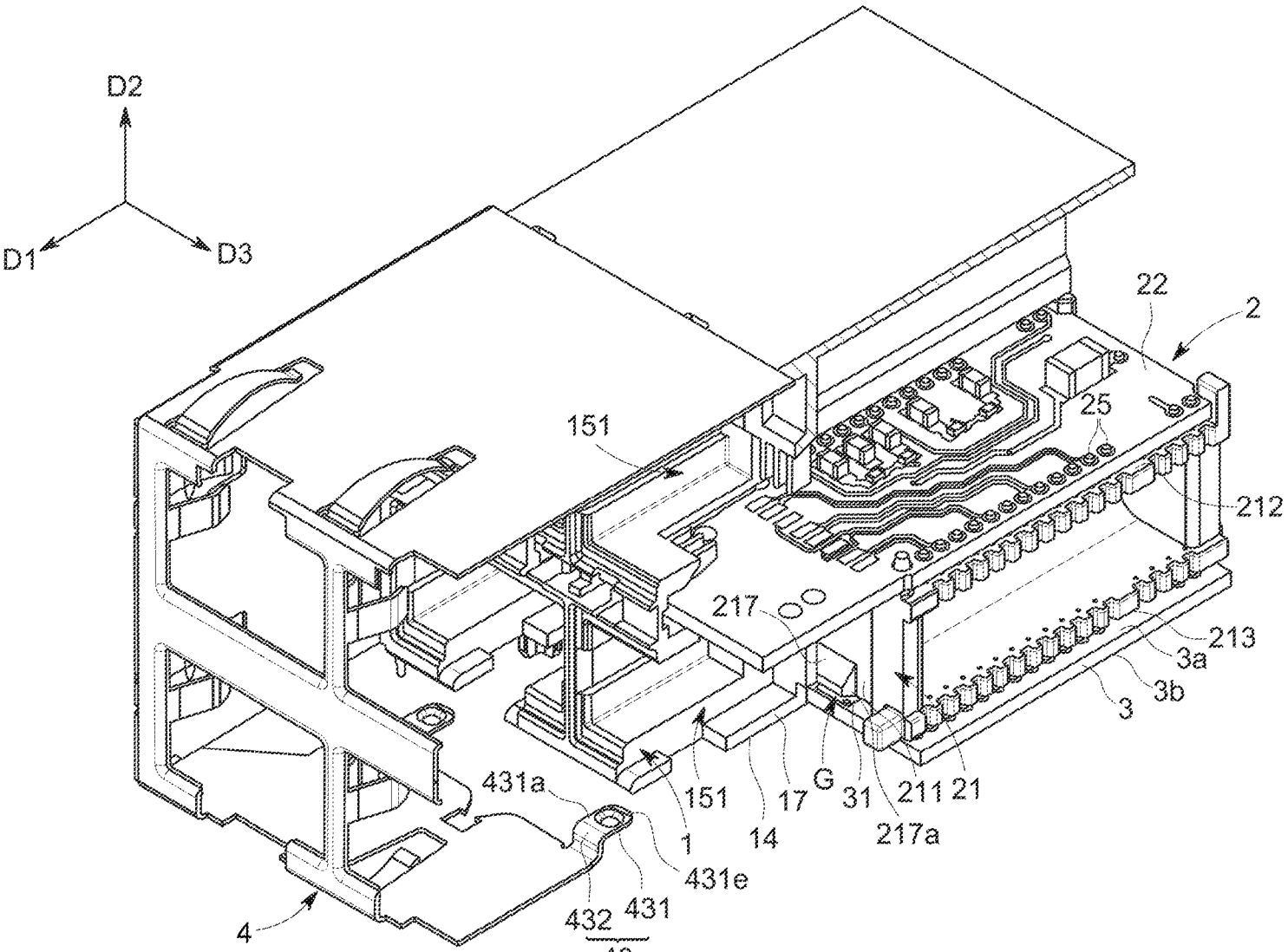
FIG. 8 is a cross sectional exploded perspective view of FIG. 7.
Figure 9:
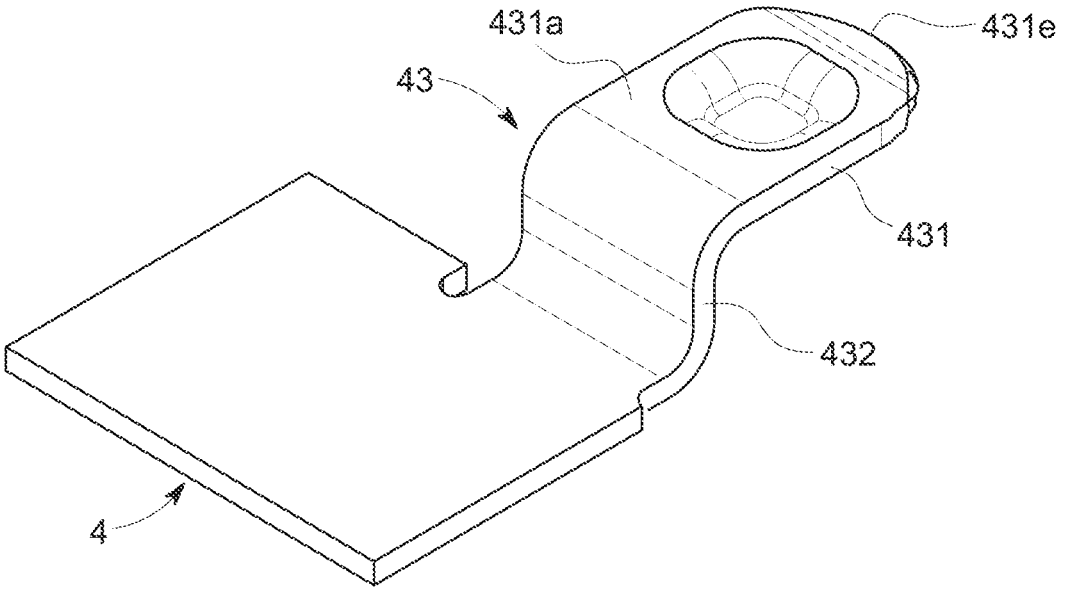
FIG. 9 is a partial perspective view of a metal shield shell of the embodiment illustrating a ground tongue of the metal shield shell.
Figure 10:
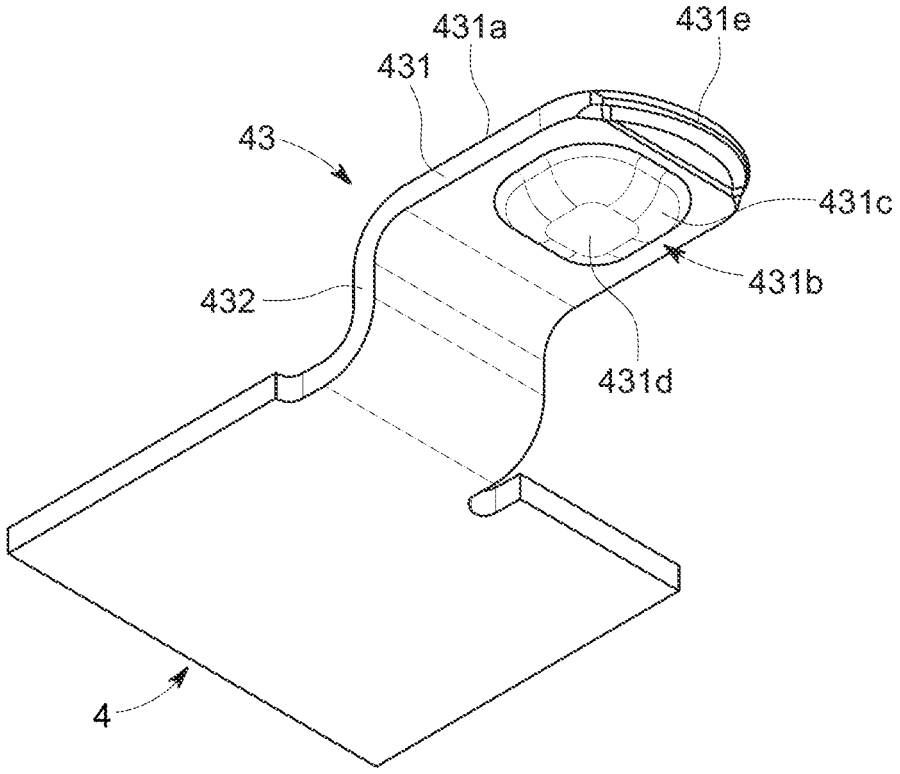
FIG. 10 is a partial perspective view of FIG. 9 viewed from another angle.
Figure 11:
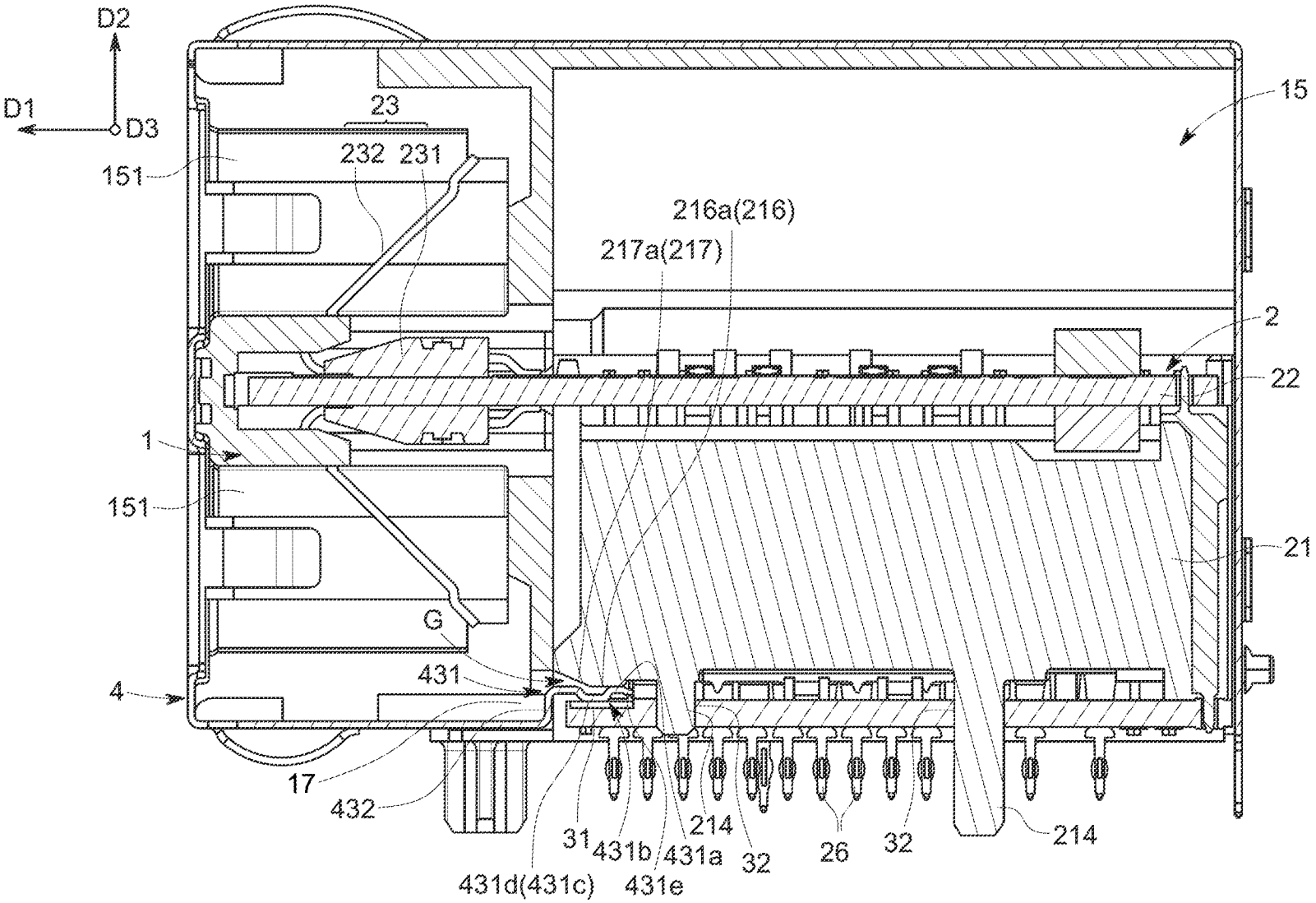
FIG. 11 is a sectional view of the embodiment.
Figure 12:
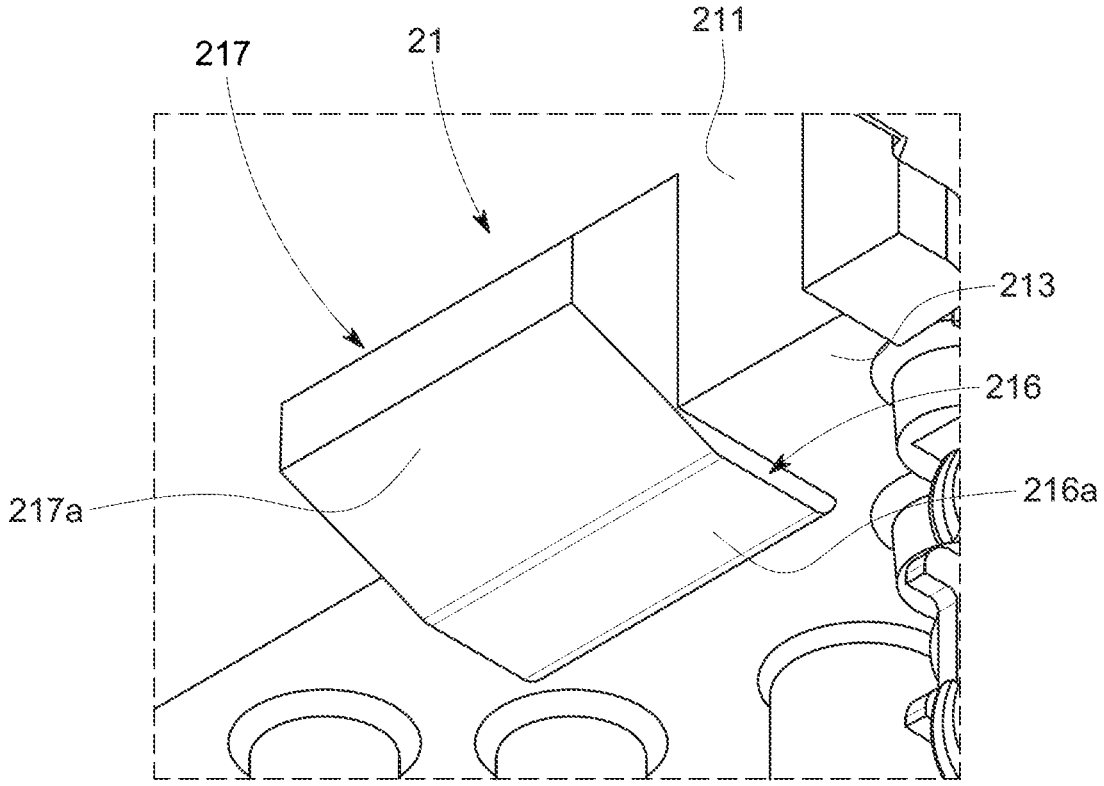
FIG. 12 is a partial enlarged perspective view of FIG. 6 illustrating a pressing protrusion and a guiding protrusion of a second insulating housing.

Referring to FIG. 7 and FIG. 8, in addition, in the embodiment, the first insulating housing 1 further has avoiding openings 17 which respectively expose the insertion gaps G and allow the plurality of ground tongues 43 to pass through, the plurality of ground tongues 43 pass through the corresponding avoiding openings 17 to insert into the plurality of insertion gaps G, specifically, the plurality of avoiding openings 17 are positioned in the mating insertion grooves 151 which are positioned below and extend to the bottom face 14. Each ground tongue 43 further has a bending section 432 extends into the corresponding avoiding opening 17 of the first insulating housing 1 from down to up so as to make the contact section 431 insert into the corresponding insertion gap G. Furthermore, referring back to FIG. 2 and FIG. 4, the first insulating housing 1 further has a plurality of tenons 18 formed on the bottom face 14 and adjacent to the bottom opening 153, the bottom plate of the metal shield shell 4 further has a plurality of mortises 45 corresponding jointing the plurality of tenons 18, so as to strengthen a holding force between the metal shield shell 4 and the first insulating housing 1.

It should be noted that, the electrical connector 100 in the embodiment includes the first insulating housing 1 and the second insulating housing 21, and the insertion gap G is formed between the second insulating housing 21 and the ground pad 31 of the internal circuit board 3, however, in other varied embodiments, the insertion gap G may be formed between the first insulating housing 1 and the ground pad 31 of the internal circuit board 3, and even in a varied embodiment, the electrical connector 100 may also includes only an integrally formed insulating housing.

In conclusion, in the present disclosure, the insulating housing and the ground pad 31 of the internal circuit board 3 clamp the ground tongue 43, so that the ground tongue 43 and the ground pad 31 of the internal circuit board 3 are kept in stable and reliable contact. In addition, the contact plane portion 431*d* of the bottom surface 431*c* of the bulge 431*b* of the ground tongue 43 and the ground pad 31 form face-to-face contact, which can reduce contact impedance between the ground tongue 43 and the ground pad 31. In addition, furthermore, since the ground tongue 43 and the internal circuit board 3 have elasticity, when the electrical connector 100 is subjected to mechanical impact and vibration, the ground tongue 43 and the ground pad 31 of the internal circuit board 3 can still stably contact each other.

However, the above description is only for the embodiments of the present disclosure, and it is not intended to limit the implementing scope of the present disclosure, and the simple equivalent changes and modifications made according to the claims and the contents of the specification are still included in the scope of the present disclosure.

The invention claimed is:

1. An electrical connector, comprising:

an insulating housing;

a plurality of terminals;

an internal circuit board, the internal circuit board being provided with a ground pad, an insertion gap being formed between the ground pad and the insulating housing; and a metal shield shell covering the insulating housing and having a front portion, a top portion and a bottom portion, the bottom portion comprising a ground plate, the metal shield shell having a ground tongue that extends rearward from the ground plate, the ground tongue having a contact section, the contact section having a top surface and a bulge formed on an opposite side of the top surface, a distance between the top surface of the contact section of the around tongue and a bottom surface of the bulge being larger than the insertion gap, the ground tongue inserting into the insertion gap and the contact section of the ground tongue being clamped between the insulating housing and the ground pad to make the bottom surface of the bulge contact the ground pad.

2. The electrical connector of claim 1, wherein the bottom surface of the bulge of the ground tongue forms a contact plane portion which contacts the ground pad face-to-face.

3. The electrical connector of claim 2, wherein the insulating housing has a pressing surface corresponding to the insertion gap and protruding toward the ground pad, the contact section of the ground tongue is clamped between the pressing surface and the around pad.

4. The electrical connector of claim 1. wherein the insulating housing has a guiding oblique surface corresponding to an entrance of the insertion gap.

5. The electrical connector of claim 4, wherein the contact section of the around tongue further has a guiding edge portion which is positioned at a distal end and obliquely extends cooperatively corresponding to the guiding oblique surface.

6. An electrical connector, comprising:

a first insulating housing;

a terminal module provided to the first insulating housing, the terminal module comprising a second insulating housing and a plurality of terminals;

an internal circuit board provided to the second insulating housing of the terminal module, the internal circuit board being provided with a ground pad, an insertion gap being formed between the ground pad and the second insulating housing; and a metal shield shell covering the first insulating housing and having a front portion, a top portion and a bottom portion, the bottom portion comprising a ground plate, the metal shield shell having a ground tongue that extends rearward from the ground plate, the ground tongue having a contact section, the contact section having a top surface and a bulge formed on an opposite side of the top surface, a distance between the top surface of the contact section of the around tongue and a bottom surface of the bulge being larger than the insertion gap, the ground tongue inserting into the insertion gap and the contact section of the ground tongue being clamped between the second insulating housing and the ground pad to make the bottom surface of the bulge contact the ground pad.

7. The electrical connector of claim 6, wherein the bottom surface of the bulge of the ground tongue forms a contact plane portion which contacts the ground pad face-to-face.

8. The electrical connector of claim 7, wherein the second insulating housing has a pressing surface corresponding to the insertion gap and protruding toward the around pad, the contact section of the ground tongue is clamped between the pressing surface and the ground pad.

9. The electrical connector of claim 6, wherein the second insulating housing has a guiding oblique surface corresponding to an entrance of the insertion gap.

10. The electrical connector of claim 9, wherein the contact section of the ground tongue further has a guiding edge portion which is positioned at a distal end and obliquely extends cooperatively corresponding to the guiding oblique surface.

11. The electrical connector of claim 6, wherein the first insulating housing has an avoiding opening through which the ground tongue passes to insert into the insertion gap.

12. The electrical connector of claim 11, wherein the ground tongue further has a bending section extending into the avoiding opening of the first insulating housing to make the contact section insert into the insertion gap.

* * * * *